US010556644B2

(12) United States Patent
Kim et al.

(10) Patent No.: US 10,556,644 B2
(45) Date of Patent: Feb. 11, 2020

(54) COUPLING DEVICE FOR RECOVERING UNMANNED SHIP AND COUPLING CONTROL METHOD USING SAME

(71) Applicant: KOREA INSTITUTE OF OCEAN SCIENCE & TECHNOLOGY, Ansan-si, Gyeonggi-do (KR)

(72) Inventors: Sun Young Kim, Daejeon (KR); Yeon Gyu Kim, Daejeon (KR); Nam Sun Son, Daejeon (KR)

(73) Assignee: KOREA INSTITUTE OF OCEAN SCIENCE & TECHNOLOGY, Ansan-si, Gyeonggi-do (KR)

( * ) Notice: Subject to any disclaimer, the term of this patent is extended or adjusted under 35 U.S.C. 154(b) by 0 days.

(21) Appl. No.: 15/745,997

(22) PCT Filed: Mar. 15, 2017

(86) PCT No.: PCT/KR2017/002773
§ 371 (c)(1),
(2) Date: Jan. 19, 2018

(87) PCT Pub. No.: WO2017/171273
PCT Pub. Date: Oct. 5, 2017

(65) Prior Publication Data

US 2018/0208274 A1 Jul. 26, 2018

(30) Foreign Application Priority Data

Mar. 29, 2016 (KR) ..... 10-2016-0037328
Mar. 29, 2016 (KR) ..... 10-2016-0037330

(51) Int. Cl.
*B63C 7/00* (2006.01)
*B63B 27/10* (2006.01)
(Continued)

(52) U.S. Cl.
CPC ..... *B63B 27/10* (2013.01); *B63B 21/56* (2013.01); *B63B 27/08* (2013.01); *B63C 11/00* (2013.01);
(Continued)

(58) Field of Classification Search
CPC ..... B63B 21/56; B63B 21/58; B63B 21/60; B63B 2021/56; B63B 2021/58;
(Continued)

(56) References Cited

U.S. PATENT DOCUMENTS 6,390,012 B1 5/2002 Watt et al.
8,109,223 B2 * 2/2012 Jamieson ..... B63G 8/001 114/312
(Continued)

FOREIGN PATENT DOCUMENTS

JP 2005-069660 A 3/2005
KR 10-2007-0081480 A 8/2007
KR 10-2010-0121089 A 11/2010

OTHER PUBLICATIONS

International Search Report for PCT/KR2017/002773 dated Jun. 8, 2017 from Korean Intellectual Property Office.

*Primary Examiner* — Daniel V Venne
(74) *Attorney, Agent, or Firm* — Revolution IP, PLLC

(57) ABSTRACT

A coupling device for recovering an unmanned ship includes: a coupling unit, which is lifted and lowered by being connected to a crane provided in a mother ship; an accommodation unit provided in the unmanned ship, and having a vertically communicating coupling hole; a guide unit performing guiding such that the coupling unit is coupled to the accommodation unit, and including a towing line formed to be long, and a winch connected to the other side of the towing line so as to selectively wind or unwind the towing line; and a control unit including a sensing part for sensing the tension applied to the towing line by the
(Continued)

driving of the winch, and a control part for lowering the coupling unit connected to the crane, if the intensity of the tension sensed by the sensing part is a preset value or higher.

15 Claims, 12 Drawing Sheets

(51) Int. Cl.

| | |
|---|---|
| ***B63B 27/08*** | (2006.01) |
| ***B63G 8/04*** | (2006.01) |
| ***B63C 11/48*** | (2006.01) |
| ***B63G 8/00*** | (2006.01) |
| ***B63C 11/00*** | (2006.01) |
| ***B63G 8/42*** | (2006.01) |
| ***B66D 1/48*** | (2006.01) |
| ***B63B 21/56*** | (2006.01) |
| ***B66D 1/52*** | (2006.01) |
| *B63B 35/00* | (2006.01) |

(52) U.S. Cl.
CPC ..... *B63C 11/48* (2013.01); *B63G 8/00* (2013.01); *B63G 8/04* (2013.01); *B63G 8/42* (2013.01); *B66D 1/48* (2013.01); *B66D 1/525* (2013.01); *B63B 2035/006* (2013.01); *B63B 2205/04* (2013.01); *B63B 2708/00* (2013.01)

(58) Field of Classification Search
CPC ..... B63B 2021/60; B63B 27/04; B63B 27/08; B63B 27/10; B63B 27/12; B63B 2027/16; B63B 2027/165; B63B 35/00; B63B 2035/00; B63B 2035/006; B63B 2035/007; B63B 2035/008; B63B 2205/02; B63B 2205/04; B63B 2205/06; B63B 2205/08; B63B 2708/00; B66D 1/525
USPC ..... 114/44, 51, 242, 249, 252, 253, 254
See application file for complete search history.

(56) References Cited

U.S. PATENT DOCUMENTS

| | | | | |
|---|---|---|---|---|
| 8,145,369 | B1 * | 3/2012 | Tureaud | B63B 21/66 701/1 |
| 8,146,527 | B2 * | 4/2012 | Pellen | B63B 21/00 114/249 |
| 8,430,049 | B1 * | 4/2013 | Tureaud | B63G 8/42 114/258 |
| 8,590,476 | B2 * | 11/2013 | Goudeau | B63B 27/36 114/322 |
| 8,831,393 | B2 * | 9/2014 | Jung | G02B 6/4471 114/322 |
| 8,881,665 | B2 * | 11/2014 | Brizard | B63B 21/66 114/259 |
| 9,387,911 | B2 * | 7/2016 | Jamieson | B63G 8/001 |
| 9,540,076 | B1 * | 1/2017 | Trail | B63B 27/08 |
| 9,592,895 | B2 * | 3/2017 | Yu | B63G 8/001 |
| 9,855,999 | B1 * | 1/2018 | Trail | B63B 27/08 |
| 9,969,470 | B2 * | 5/2018 | Brizard | G01V 1/3852 |
| 10,029,771 | B2 * | 7/2018 | Kim | B63C 7/26 |
| 2013/0220205 | A1 | 8/2013 | Henriken | |

* cited by examiner

COUPLING DEVICE FOR RECOVERING UNMANNED SHIP AND COUPLING CONTROL METHOD USING SAME

TECHNICAL FIELD

The present invention relates to a coupling device for recovering an unmanned ship and a coupling control method using the same, and more particularly, to a coupling device for recovering an unmanned ship capable of controlling the degree of winding and unwinding of a towing line and the lifting and lowering of the coupling device so that the towing line provided in the unmanned ship can be connected to the coupling device provided in a mother ship and the coupling device can be coupled with the unmanned ship, and a coupling control method using the same.

BACKGROUND ART

With the development of unmanned technology, development of unmanned ships has been progressing actively in order to perform operations which are dangerous and inefficient when being performed by a manned vessel among marine operations such as maritime investigation, marine reconnaissance and surveillance, marine accident response, and the like.

When operating an unmanned ship in the ocean, a method is employed in which the unmanned ship is mounted on a mother ship so as to execute a task when an operation is required and the unmanned ship is recovered to the mother ship after performing the task. This method has the advantage of reducing the time required to move the unmanned ship from land to sea and reducing the distance between the unmanned ship and a remote control station by installing the remote control station on the mother ship that monitors and controls the situation of the unmanned ship remotely. On the other hand, in order to operate the unmanned ship in this manner, a method of recovering the unmanned ship to the mother ship should be considered.

Various methods for recovering the unmanned ship to the mother ship have been developed. One of the various methods is to launch a heaving line provided in the unmanned ship to the mother ship and recover the unmanned ship when a crew hangs the heaving line on a crane or an electric winch.

In this case, a wire connected to the crane should be connected to the unmanned ship in order to recover the unmanned ship through the crane provided in the mother ship or the like. Since a crew is not carried on the unmanned ship, the crew should move from the mother ship to the unmanned ship to connect the wire, or should connect to the unmanned ship through a hook, or the like. However, there is a problem in that it is not easy to work in a sea with high waves. That is, there is a problem that a safety accident may occur when the crew gets on the unmanned ship and connects the wire. Therefore, a method for solving such a problem is required.

DISCLOSURE

Technical Problem

The present invention has been made in view of the above problems, and provides a coupling device for recovering an unmanned ship capable of moving an unmanned ship to a location adjacent to a coupling unit so that the coupling unit of a crane provided in a mother ship or a wharf can be coupled to an accommodation unit provided in the unmanned ship, and a coupling control method using the same.

The present further provides a coupling device for recovering an unmanned ship capable of preventing an unmanned ship moved to a location adjacent to the coupling unit from being overloaded by an attempt to lift the unmanned ship before it is coupled with the coupling unit on the water and of controlling to couple the coupling unit to the accommodation unit, and a coupling control method using the same.

The problems of the present invention are not limited to the above-mentioned problems, and other problems not mentioned can be clearly understood by those skilled in the art from the following unit description.

Technical Solution

In an aspect, there is provided a coupling device for recovering an unmanned ship, the coupling device including: a coupling unit, which is lifted and lowered by being connected to a crane provided in a mother ship, and is formed to be long such that one side thereof selectively protrudes expansively along a circumference thereof; an accommodation unit provided in the unmanned ship, and having a vertically communicating coupling hole such that at least a portion of the coupling unit is inserted therein; a guide unit performing guiding such that the coupling unit is coupled to the accommodation unit, and including a towing line formed to be long so as to be coupled to the coupling unit in a state in which one side thereof passes through the coupling hole, and a winch connected to the other side of the towing line so as to selectively wind or unwind the towing line; and a control unit including a sensing part for sensing a tension applied to the towing line by a driving of the winch, and a control part for lowering the coupling unit connected to the crane, if an intensity of the tension sensed by the sensing part is a preset value or higher, wherein the control part lowers the coupling unit in correspondence to a length of the towing line wound by the winch, when the coupling unit is lowered, such that the coupling unit is coupled to the accommodation unit.

The control part winds the winch so that the unmanned ship is moved to a location adjacent to the mother ship by the towing line wound by the winch, when the intensity of the tension sensed by the sensing part is lower than the pre-set value.

The control part stops an operation of the winch, when the coupling unit and the accommodation unit are coupled.

The control part releases the winch so that the coupling unit can be separated, when the coupling unit is disengaged from the accommodation unit.

The pre-set value is an intensity of the tension applied to the towing line in a state in which the winch winds the towing line and lifts the unmanned ship from a water surface.

The coupling unit includes: a body formed to be long in a vertical direction and an upper portion thereof is connected to the crane; a wing unit configured to be rotatable in a vertical direction at a portion along a longitudinal direction of the body, and having one side protruding from the body when rotating; a lifting and lowering unit coupled to the other side of the wing unit in the body, and adjusting a location thereof in a vertical direction to control a protrusion of the wing unit; and a driving unit for selectively moving the lifting and lowering unit in a vertical direction in the body.

The driving unit is formed in a long shaft shape in a vertical direction and selectively rotates, wherein a vertical location of the lifting and lowering unit is adjusted by rotation of the driving unit.

The lifting and lowering unit has at least one elastic member disposed in a vertical direction, wherein the elastic member is coupled to the other side of the wing unit.

The coupling unit inserted into the accommodation unit in a state in which the wing unit is expanded, and the wing unit is temporarily folded by an elasticity of the elastic member.

A plurality of wing units are spaced apart and provided along a circumference of the coupling unit.

The accommodation unit includes: a support unit provided on the unmanned ship; and a guide unit having the coupling hole at an upper portion of the support unit and guiding the coupling unit to be inserted into the coupling hole.

The guide unit includes: a first guide surface having a relatively larger circumference than the coupling unit and having an inclined surface whose circumference decreases toward a lower portion; and a second guide surface continuously formed in a lower portion of the first guide surface and having a relatively larger inclination angle.

A cross-sectional shape of the first guide surface along a vertical direction is formed to have a curvature in a downward direction.

The second guide surface is tapered in a vertical direction, and is in contact with an outer surface of the coupling unit.

One end of the towing line is launched by a separate launcher provided in the unmanned ship, is transmitted to the mother ship, and is coupled to the coupling unit.

In another aspect, there is provided a coupling control method using the coupling device for recovering an unmanned ship, the method including: a launching step of launching the towing line to the mother ship through the launcher; a towing line coupling step of coupling the towing line to the coupling unit connected to the crane; an unmanned ship towing step of towing the unmanned ship to be adjacent to the mother ship by winding the towing line by the winch; a coupling unit coupling step of lowering the coupling unit in correspondence to the length of the towing line wound by the winch if the intensity of the tension applied to the towing line is the preset value or higher, and coupling the coupling unit to the accommodation unit; and an unmanned ship recovering step of lifting the unmanned ship by using the crane and recovering the unmanned ship to the mother ship.

The unmanned ship recovering step includes stopping an operation of the winch and lifting the unmanned ship when the coupling unit and the accommodation unit are coupled to each other.

Advantageous Effects

In order to solve the above-mentioned problems, a coupling device for recovering an unmanned ship and a coupling control method using the same according to the present invention have the following effects.

First, there is an advantage that an unmanned ship is moved to a location adjacent to a coupling unit so that the coupling unit of a crane provided in a mother ship or a wharf can be coupled to an accommodation unit provided in the unmanned ship.

Second, there is an advantage in that the coupling device can be prevented from being overloaded by an attempt to lift the unmanned ship before the unmanned ship moved to a location adjacent to the coupling unit is coupled with the coupling unit on the water, thereby preventing a winch from overloading and preventing a towing line from being broken.

Third, there is an advantage in that human accidents can be prevented by recovering the unmanned ship to the mother ship without human help.

The effects of the present invention are not limited to the effects mentioned above, and other effects not mentioned can be clearly understood by those skilled in the art from the description of the claims.

DESCRIPTION OF DRAWING UNITS

The accompanying drawing units incorporated herein illustrate preferred embodiments of the invention and, together with the description, serve to accomplish a further understanding of the technical concept of the invention, and should not be construed as being limited to the matters described in drawing units.

MODE FOR INVENTION

Figure 1:
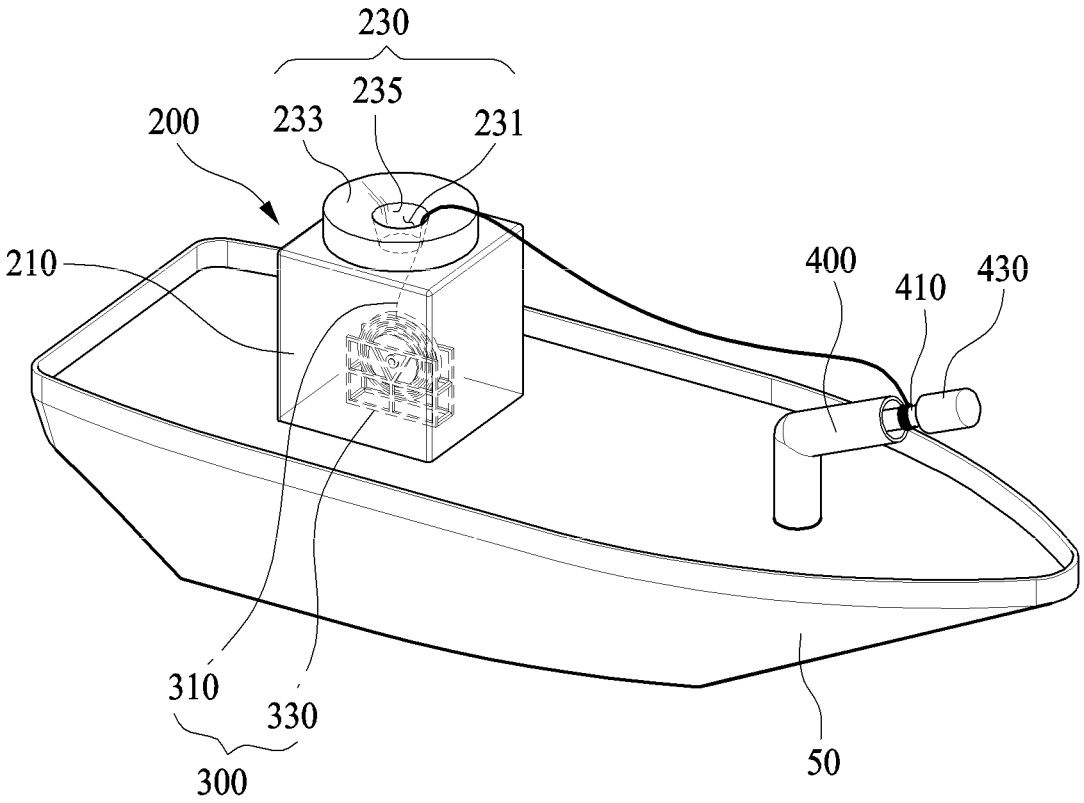
FIG. 1 is a diagram illustrating an unmanned ship of a coupling device for recovering an unmanned ship according to an embodiment of the present invention.

Hereinafter, preferred embodiments of the present invention will be described with reference to the accompanying drawing units. In describing the present embodiment, the same designations and the same reference numerals are used for the same components, and further description thereof will be omitted.

A coupling device for recovering an unmanned ship according to an embodiment of the present invention will be described with reference to FIG. 1 to FIG. 3 and FIG. 12.

Figure 2:
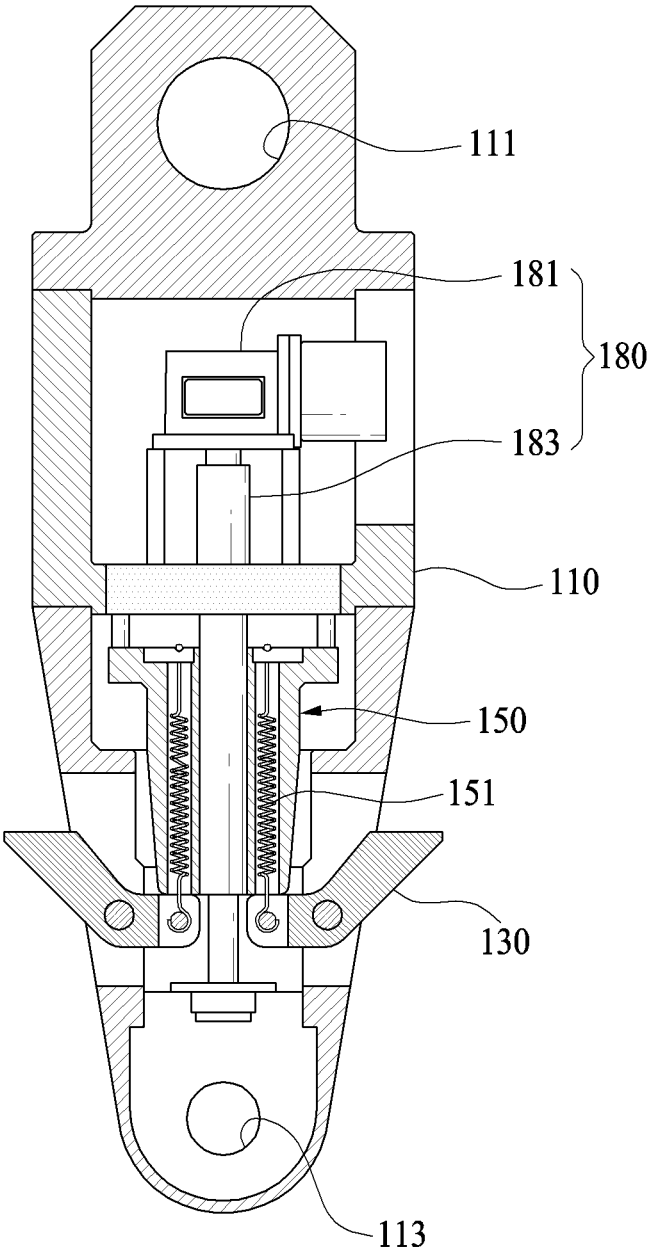
FIG. 2 is a diagram illustrating a coupling unit of a coupling device for recovering an unmanned ship according to an embodiment of the present invention.
Figure 3:
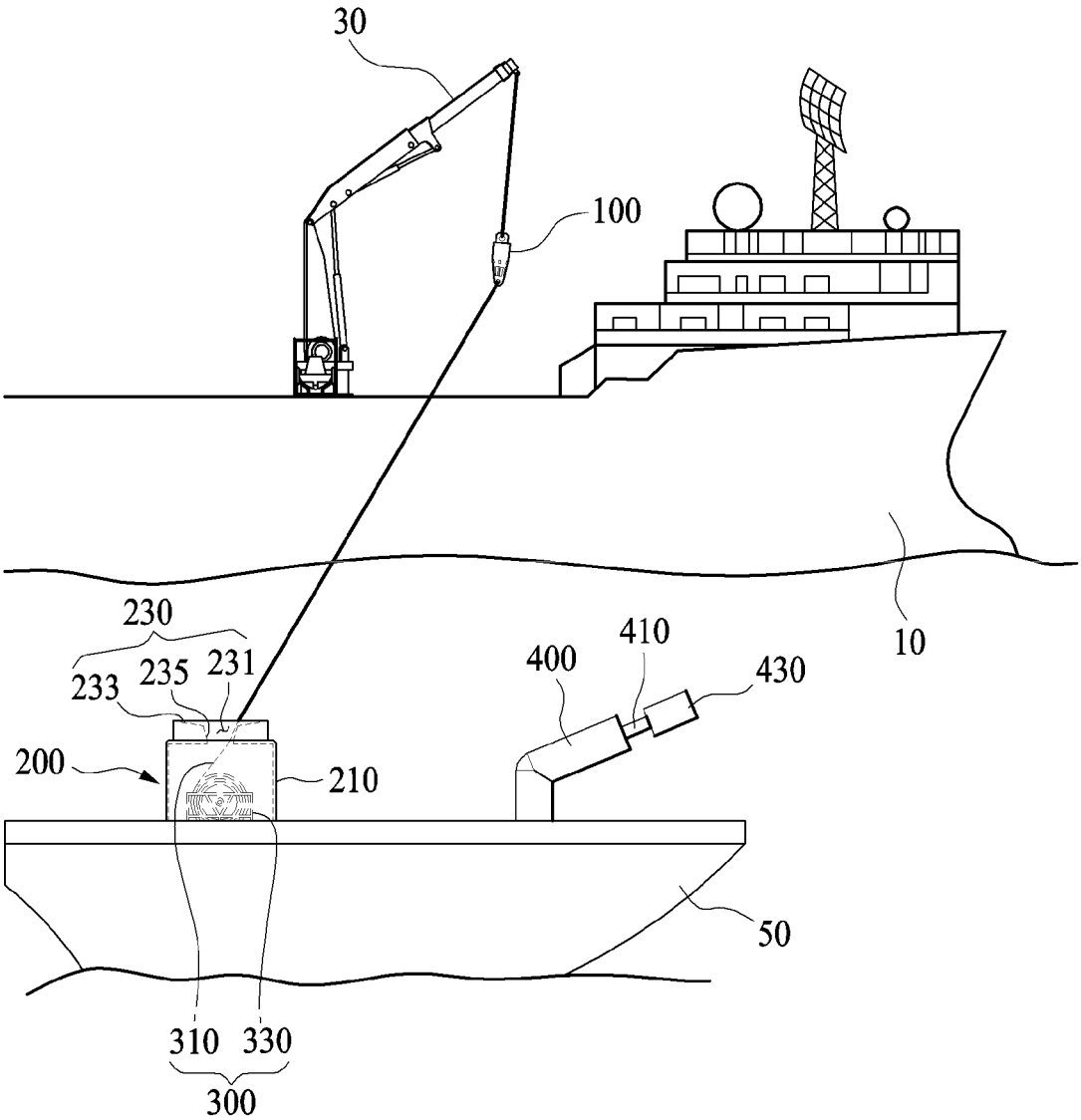
FIG. 3 is a diagram illustrating a coupling state of a mother ship of a coupling device for recovering an unmanned ship and an unmanned ship according to an embodiment of the present invention.
Figure 12:
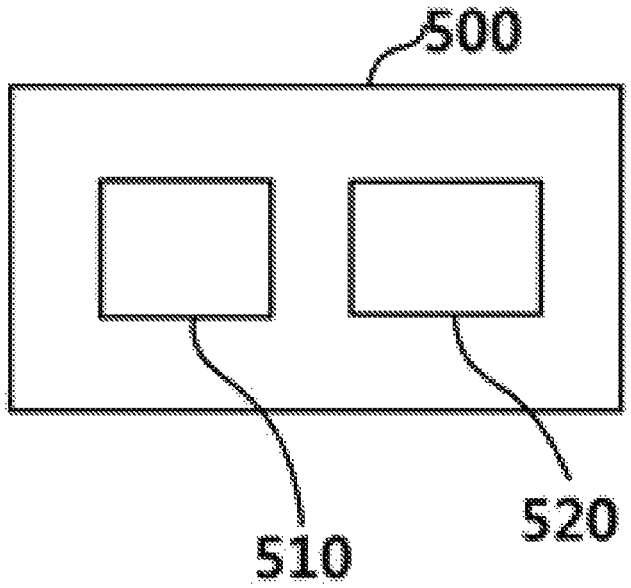
FIG. 12 is a diagram illustrating a control box.

FIG. 1 is a diagram illustrating an unmanned ship of a coupling device for recovering an unmanned ship according to an embodiment of the present invention, FIG. 2 is a diagram illustrating a coupling unit of a coupling device for recovering an unmanned ship according to an embodiment of the present invention, and FIG. 3 is a diagram illustrating a coupling state of a mother ship of a coupling device for recovering an unmanned ship and an unmanned ship according to an embodiment of the present invention. FIG. 12 is a diagram illustrating a control box.

As shown in FIG. 1 to FIG. 3 and FIG. 12, a coupling device for recovering an unmanned ship according to an embodiment of the present invention may include a coupling unit 100, a accommodation unit 200, a guide unit 300, and a control unit 500.

The coupling unit 100 may be lifted and lowered by being connected to a crane provided in a mother ship 10, formed to be long such that one side thereof selectively protrudes expansively along the circumference thereof, and be coupled to the accommodation unit 200 provided in an unmanned ship 50 describe later, and may include a body 110, a wing unit 130, an lifting and lowering unit 150, and a driving unit 180.

The body 110 may be formed to be long in the vertical direction and may have a first link 111 connected to a wire of the crane 30 at an upper portion thereof and a second link 113 connected to a towing line 310 described later at a lower portion thereof.

Here, the wire of the crane 30 may be a wire connecting the crane 30 and the coupling unit 100. A hoisting machine such as a winch 330 provided in the crane 30 may lift and lower the wire of the crane 30 to lift and lower the coupling unit 100. Since a detailed driving method thereof is obvious to those skilled in the art, a description thereof is omitted.

In addition, the body 110 may be formed in a cylindrical shape, and the circumference of at least a part of the body 110 becomes decreased toward the lower side.

The wing unit 130 may selectively protrude expansively along the circumference of the body 110.

The wing unit 130 may be configured to be vertically rotatable at a portion of lower side along the longitudinal direction of the body 110, and one side of the wing unit 130 may protrude outside the body 110 when rotating.

In addition, a plurality of wing units 130 may be spaced apart each other along the circumference of the body 110.

Here, each of the wing units 130 may be hinged so as to be vertically rotated in an inner lower side of the body 110 so that one side thereof may be received into the body 110 or may be protruded, and the other side may be coupled with the lifting and lowering unit 150 described later.

Since the lifting and lowering unit 150 may be in contact with the other side of the wing unit 130 in the inside of the body 110 and the location of the lifting and lowering unit 150 may be vertically adjusted by the driving unit 180 described later, one side of the wing unit 130 may protrude outside the body 110 when the lifting and lowering unit 150 moves downward, and the protruding of the wing unit 130 may be adjusted so that one side of the wing unit 130 can be received into the body 110 when the lifting and lowering unit 150 moves upward. Here, the lifting and lowering unit 150 may include an elastic member 151.

The elastic member 151 may be formed in the same number corresponding to the number of the wing unit 130 and arranged in the vertical direction.

One end of each of the elastic members 151 may be connected to the upper end of the lifting and lowering unit 150 and the other end may be coupled with a ring that can be formed in the other side of each of the wing units 130.

In addition, the elastic member 151 may be formed to have the same length as that of the lifting and lowering unit 150. Since the elastic member 151 coupled to the other side of the wing unit 130 has an elastic restoring force for restoring the original length, when the lifting and lowering unit 150 moves upward and moves away from the wing unit 130, the other side of the wing unit 130 can be pulled toward the upper side of the body 110 so that one side of the wing unit 130 may protrude to the outside of the body 110.

The driving unit 180 may selectively move up and down the lifting and lowering unit 150 for controlling the protrusion of the wing unit 130 in the body 110. The driving unit 180 may include a motor 181 and a shaft 183.

The motor 181 may be coupled to the shaft 183 in the body to rotate the shaft 183.

Here, the motor 181 may be remotely controlled from a cockpit or a control room or may be implemented by a separate system provided with a sensor so as to be automatically operated by the sensor. Since a detailed system driving method is obvious to those skilled in the art, a description thereof is omitted.

The shaft 183 may be formed to be long in the vertical direction, and may be coupled to the lifting and lowering unit 150 such that the lifting and lowering unit 150 can move upward when the shaft 183 rotates in one direction from a center shaft in the lifting and lowering unit 150, and the lifting and lowering unit 150 can move downward when the shaft 183 rotates in the other direction from the center shaft.

Therefore, the shaft 183 may rotate by driving the motor 181 to move the lifting and lowering unit 150 in the vertical direction.

The accommodation unit 200 may be provided in the unmanned ship 50, has a vertically communicating coupling hole 231 such that at least a portion of the coupling unit 100 is inserted therein, and the wing unit 130 may protrude from the inside of the accommodation unit 200 to be coupled with the coupling unit 100. In addition, the accommodation unit 200 may further include a support unit 210 and a guide unit 230 which are coupled to the coupling unit 100.

The support unit 210 may be provided in the unmanned ship 50, support the guide unit 230 which is substantially coupled with the coupling unit 100 of the crane 30. The support unit 210 may be provided with the guide unit 300, which will be described later, formed therein, and with a through hole, through which the towing line 310 described later can pass, that is formed on one side of the upper surface.

The support unit 210 may stably fix the guide unit 230 at a certain height to be more easily coupled with the coupling unit 100.

The guide unit 230 may be formed in a cylindrical shape and has the coupling hole 231 communicating with the through hole at an upper portion of the support unit 210, and may guide the coupling unit 100 to be inserted into the coupling hole 231. The guide unit 230 may be configured to include a first guide surface 233 and a second guide surface 235.

The first guide surface 233 may have a relatively larger circumference than the coupling unit 100 and have an inclined surface whose circumference decreases toward a lower portion, and a sectional shape thereof along the vertical direction may have a curvature in a downward direction.

That is, the first guide surface 233 may be inclined downward and have a curvature toward the inner circumference from the outer circumference.

Therefore, the first guide surface 233 may guide the coupling unit 100 to move to the inner circumference when the coupling unit 100 moves downward from the outer circumference.

The second guide surface 235 may be formed continuously in a lower portion of the first guide surface 233 and has a relatively larger inclination angle.

More specifically, the second guide surface 235 may be tapered in the vertical direction, and may be in contact with the outer surface of the coupling unit 100.

That is, as for the second guide surface 235, when the coupling unit 100 is inserted into the coupling hole 231, if the circumference of the body 110 of the coupling unit 100 is larger than the circumference of the second guide surface 235, the coupling unit 100 may be in contact with the second guide surface 235 so that a part of the coupling unit 100 can be fixed while being inserted into the accommodation unit 200.

Next, the guide unit 300 may guide the coupling unit 100 to be coupled to the accommodation unit 200, and may include the towing line 310 and the winch 330.

The towing line 310 may be formed to be long and may be coupled to the coupling unit 100 in a state in which one side of the towing line 310 passes through the coupling hole 231.

One end of the towing line 310 may be moved to the mother ship 10 by a launcher 400 provided in the unmanned ship 50 and may be coupled to the second link 113.

The launcher 400 may be provided at one side of the unmanned ship 50, and may be an apparatus for launching the towing line 310 which can be connected to the second link 113 to the mother ship 10.

The launcher 400 may have a cannon-shaped structure and include a heaving line 410.

The heaving line 410 may be formed to be long, and one end of the heaving line 410 may be connected to the launcher 400, and a launching member 430 may be formed in the other end.

One end of the towing line 310 may be connected to the heaving line 410 so that the towing line 310 may be moved to the mother ship 10 when the heaving line 410 is launched to the mother ship 10.

When the heaving line 410 is launched to the mother ship 10, a person on the mother ship 10 may connect the towing line 310 to the second link 113.

Here, it is illustrated that the launcher 400 is a cannon-shaped structure and is configured to launch the heaving line 410 to the mother ship 10. However, it is explained for illustrative purposes, and it is obvious that any type of structure can be used as long as it can move the towing line 310 to the mother ship 10. For example, a drone or a buoy may be used instead of launching the heaving line 410 by a cannon-shaped structure.

The winch 330 may be connected to the other side of the towing line 310 to selectively wind or unwind the towing line 310.

The winch 330 may wind the towing line 310 connected to the coupling unit 100 so that the coupling unit 100 can be coupled with the accommodation unit 200.

When the unmanned ship 50 is recovered to the mother ship 10 or when the unmanned ship 50 is launched into the sea from the mother ship 10, the winch 330 may unwind the towing line 310 so that the coupling unit 100 coupled with the accommodation unit 200 can be disengaged from the accommodation unit 200.

Here, the winch 330 may be a separate system which can wind or unwind the towing line 310, and since a detailed system driving method is obvious to a person skilled in the art, a description thereof is omitted.

The control unit 500 may control the degree of winding and unwinding of the winch 330 and the degree of winding and unwinding of the crane 30 so that the coupling unit 100 can be coupled to the accommodation unit 200, and may include a sensing part 510 and a control part 520. The control unit 500, the sensing part 510 and the control part 520 are conventional and not essential for a proper understanding of the disclosed invention.

The sensing part 510 may be provided inside or outside the unmanned ship 50, and may sense the intensity of the tension applied to the towing line 310 by the driving of the winch 330.

More specifically, when the towing line 310 connected to the second link 113 is wound by the winch 330 by the driving of the winch 330, the sensing part 510 may sense the intensity of the tension applied to the towing line 310, and transmit a signal to the control part 520, which will be described later, when the intensity of the tension is equal to or greater than a pre-set value.

The pre-set value may be an intensity of a tension applied to the towing line 310 in a state in which the winch 330 winds the towing line 310 and lifts the unmanned ship 50 from the water.

More specifically, it is an intensity of the tension when the unmanned wire 50 is located in the straight line in the vertical direction with respect to the coupling unit 100 and the unmanned wire 50 is attempt to rise to the upper side connected to the coupling unit 100, when the winch 330 winds the towing line 310 connected to the coupling unit 100.

The control part 520 may control the degree of winding and unwinding of the winch 330 and the lifting and lowering of the coupling unit 100.

Further, the control part 520 may lower the coupling unit 100 connected to the crane 30 when the intensity of the tension sensed by the sensing part 510 is the pre-set value or higher.

Therefore, the unmanned ship 50 may be prevented from being lifted before it is coupled with the coupling unit on the water as the towing line 310 is wound by the coupling unit 100 with the pre-set value or higher, so that the overload of the winch 330 or the breakage of the towing line 310 can be prevented.

In addition, the coupling unit 100 may be lowered in correspondence to the length of the towing line 310 wound by the winch 330, so that the intensity of the tension applied to the towing line 310 can be maintained at the pre-set value.

That is, the coupling unit 100 may be coupled with the accommodation unit 200 while the unmanned ship 50 is maintained to be located in a straight line with respect to the coupling unit 100 in the vertical direction.

If the unmanned ship 50 is severely shaken due to the high waves of the sea and the intensity of the tension applied to the towing line 310 is rapidly increased beyond the pre-set value, an overload of the winch 330 may be generated or the towing line 310 may be broken even though the coupling unit 100 is lowered.

Therefore, when the intensity of the tension applied to the towing line 310 rapidly increases beyond the pre-set value, the control part 520 may loosen the towing line 310 to reduce the intensity of the tension applied to the towing line 310 to be the pre-set value or less.

That is, when the intensity of the tension applied to the towing line 310 rapidly increases beyond the pre-set value, the intensity of the tension applied to the towing line 310 cannot be maintained at the pre-set value only by the lowering of the coupling unit 100, so that the overload of the winch 330 or the breakage of the towing line 310 can be prevented by loosening the towing line 310.

Obviously, the allowable tension of the towing line may be larger than the pre-set value in consideration of safety.

When the coupling unit 100 and the accommodation unit 200 are coupled to each other, the control part 520 may stop the operation of the winch 330 so that the coupling unit 100 can be prevented from being overloaded as the towing line 310 winds the coupling unit 100 and the unmanned ship 50 is lifted from the water surface before the unmanned ship 50 is coupled with the coupling unit.

When detaching the coupling unit 100 from the accommodation unit 200, the control part 520 may control the winch 330 to be released such that the coupling unit 100 can be disengaged.

More specifically, when the wing unit 330 is separated from the inner surface of the accommodation unit 200 by lowering the coupling unit 100 by winding the winch 330, the driving unit 180 may be operated, so that the wing unit 130 can be accommodated in the body 110.

At this time, the control part 520 may unwind the winch 330 and lift the crane 30 so that the coupling unit 100 may be released from the accommodation unit 200.

Here, the control part 520 may be a separate system that checks the pre-set value sent out from the sensing part 510, and controls the crane 30 and the winch 330 according to the pre-set value, may be installed anywhere such as the unmanned ship 50 or the crane 30, and may be remotely controlled by a person, or may be an automation system.

Hereinafter, referring to FIG. 4, a launching step and a towing line towing step in a coupling control method using a coupling device for recovering an unmanned ship according to an embodiment of the present invention will be illustrated.

Figure 4:
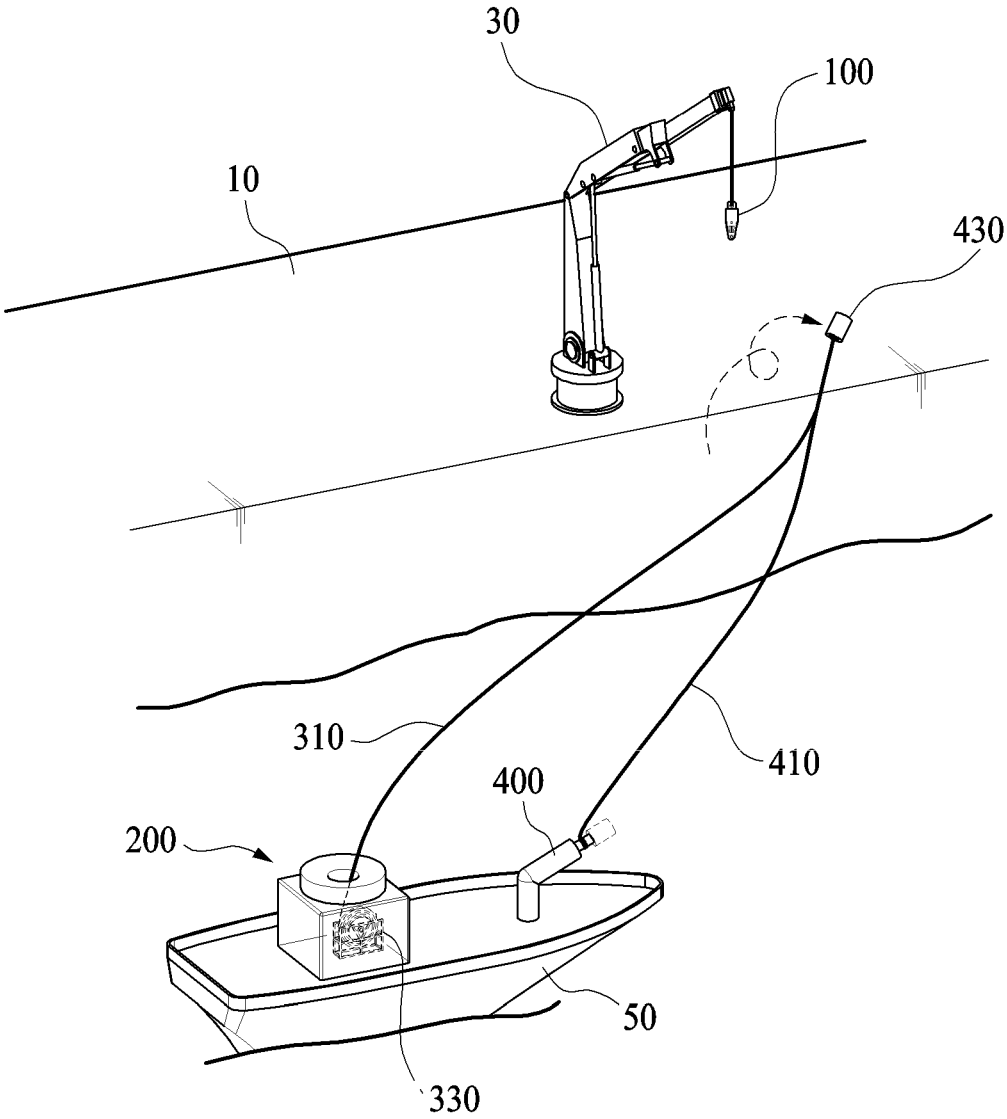
FIG. 4 is a diagram illustrating a launcher of a coupling control method using a coupling device for recovering an unmanned ship when the launcher launches a heaving line to a mother ship according to an embodiment of the present invention.

FIG. 4 is a diagram illustrating a launcher of a coupling control method using a coupling device for recovering an unmanned ship when the launcher launches a heaving line to a mother ship according to an embodiment of the present invention.

As shown in FIG. 4, the launching step is a step of launching the towing line 310 to the mother ship 10 through the launcher 400.

In more detail, when the unmanned ship 50 returns to the mother ship 10 after finishing work such as a rescue of the life in the accident area or a reconnaissance for the identification of the cause of the accident of the ship, the towing line 310 may be launched to the mother ship 10 through the launcher 400.

That is, the launcher 400 provided in the unmanned ship 50 may launch the launching member 430 to the mother ship 10 so as to recover the unmanned ship 50 to the mother ship 10.

At this time, the towing line 310 may be connected to the heaving line 410, and the control part 520 may drive the winch 330.

The winch 330 may be driven in a direction for unwinding the towing line 310 so that the towing line 310 can also be moved to the mother ship 10 when the launching member 430 is launched to the mother ship 10.

The step of connecting the towing line 310 is a step of connecting the towing line 310 to the coupling unit 100 connected to the crane 30.

More specifically, when the launching member 430 is launched to the mother ship 10, a crew member on the mother ship 10 may connect the towing line 310 connected to the heaving line 410 to the coupling device.

In addition, when the crew member connects the towing line 310 connected to the heaving line 410 to the coupling device, the heaving line 410 may be wound by the launcher 400.

The launcher 400 may be provided with a hoisting machine, such as a winch 330, that can wind or unwind the heaving line 410. Since the hoisting machine such as the winch 330 is well known to a person skilled in the art, a description thereof is omitted.

Figure 5:
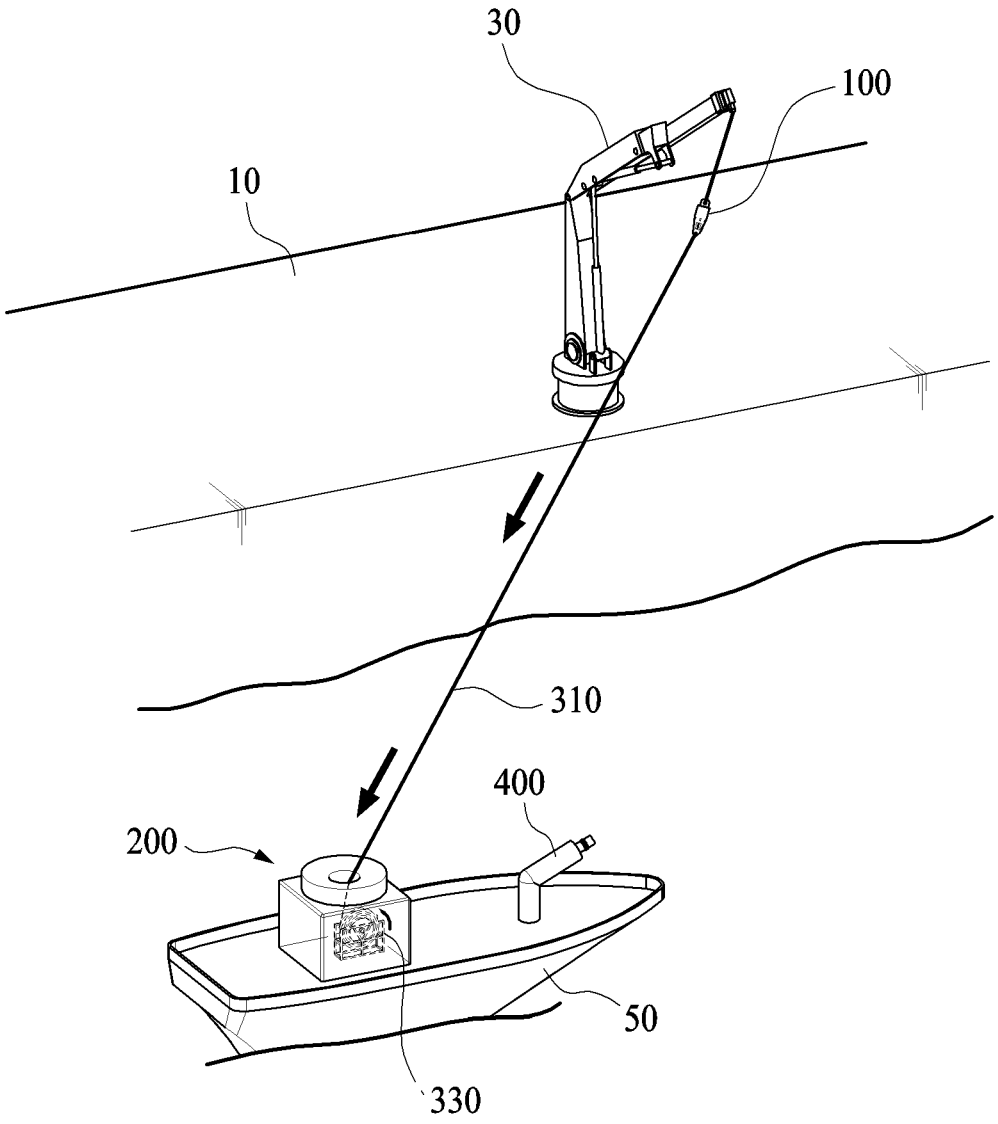
FIG. 5 is a diagram illustrating an unmanned ship of a coupling control method using a coupling device for recovering an unmanned ship when the unmanned ship moves to a location adjacent to a mother ship according to an embodiment of the present invention.
Figure 6:
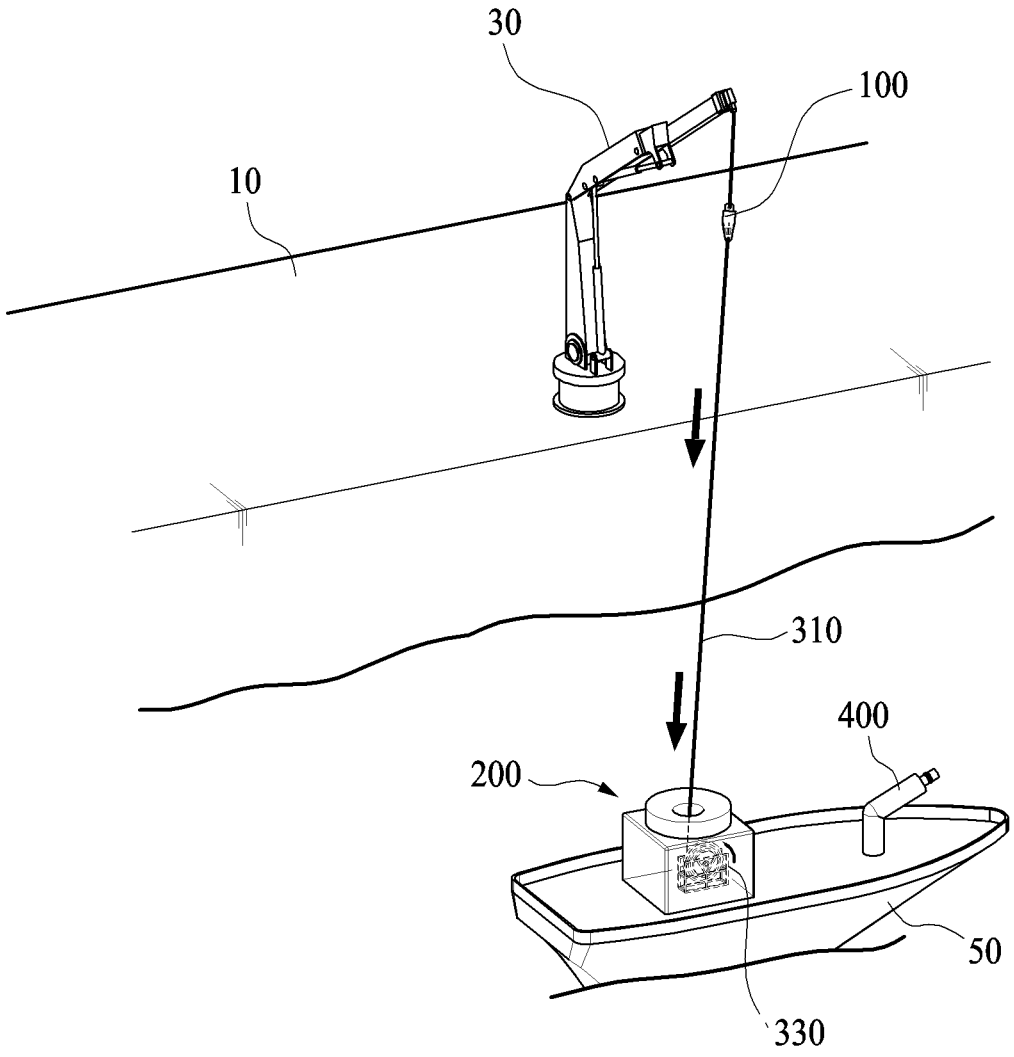
FIG. 6 is a diagram illustrating a state in which an unmanned ship of a coupling control method using a coupling device for recovering an unmanned ship when the unmanned ship is moved to a location adjacent to a mother ship according to an embodiment of the present invention.

Next, referring to FIG. 5 and FIG. 6, an unmanned ship towing step of a coupling control method using a coupling device for recovering an unmanned ship according to an embodiment of the present invention will be illustrated.

FIG. 5 is a diagram illustrating an unmanned ship of a coupling control method using a coupling device for recovering an unmanned ship when the unmanned ship moves to a location adjacent to a mother ship according to an embodiment of the present invention, and FIG. 6 is a diagram illustrating a state in which an unmanned ship of a coupling control method using a coupling device for recovering an unmanned ship when the unmanned ship is moved to a location adjacent to a mother ship according to an embodiment of the present invention.

As shown in FIG. 5 to FIG. 6, the unmanned ship towing step is a step in which the winch 330 winds the towing line 310 and tows the unmanned ship 50 to be adjacent to the mother ship 10.

The towing line 310 may be connected to the coupling unit 100 at a location where the unmanned ship 50 is spaced apart from the mother ship 10.

At this time, the control part 520 may fix the coupling unit 100 connected to the crane 30 and control the winch 330.

The winch 330 may be driven in a direction for winding the towing line 310 so that the towing line 310 is wound by the winch 330.

When the towing line 310 is wound by the winch 330, the towing line 310 connected to the coupling unit 100 may be tightened.

Thus, due to the tension applied to the towing line 310, the unmanned ship 50 which can move on the water may move to the coupling unit 100 fixed in the mother ship 10.

Accordingly, the unmanned ship 50 spaced apart from the mother ship 10 may be moved to a location adjacent to the mother ship 10.

Figure 7:
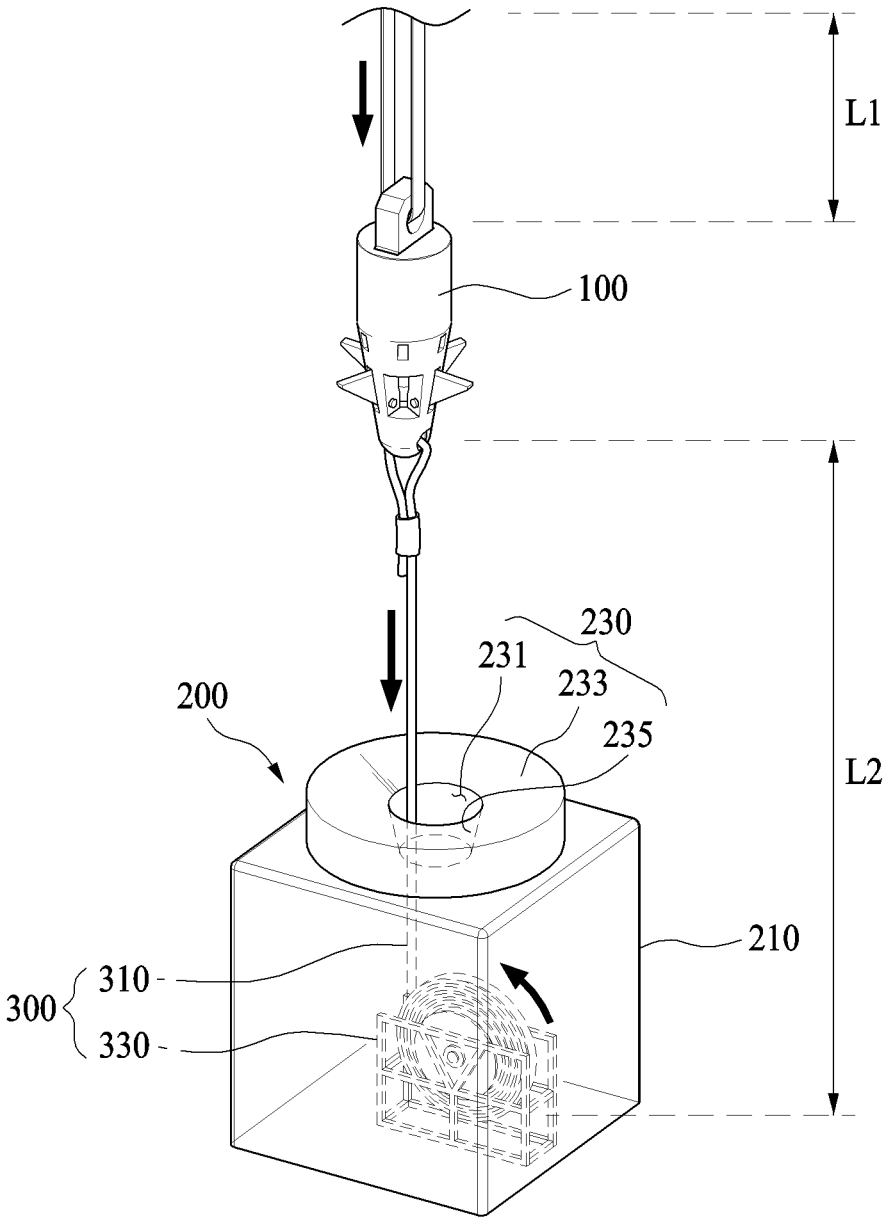
FIG. 7 is an enlarged view of a coupling device of a coupling control method using a coupling device for recovering an unmanned ship when the coupling device is lowered into an accommodation unit according to an embodiment of the present invention.
Figure 8:
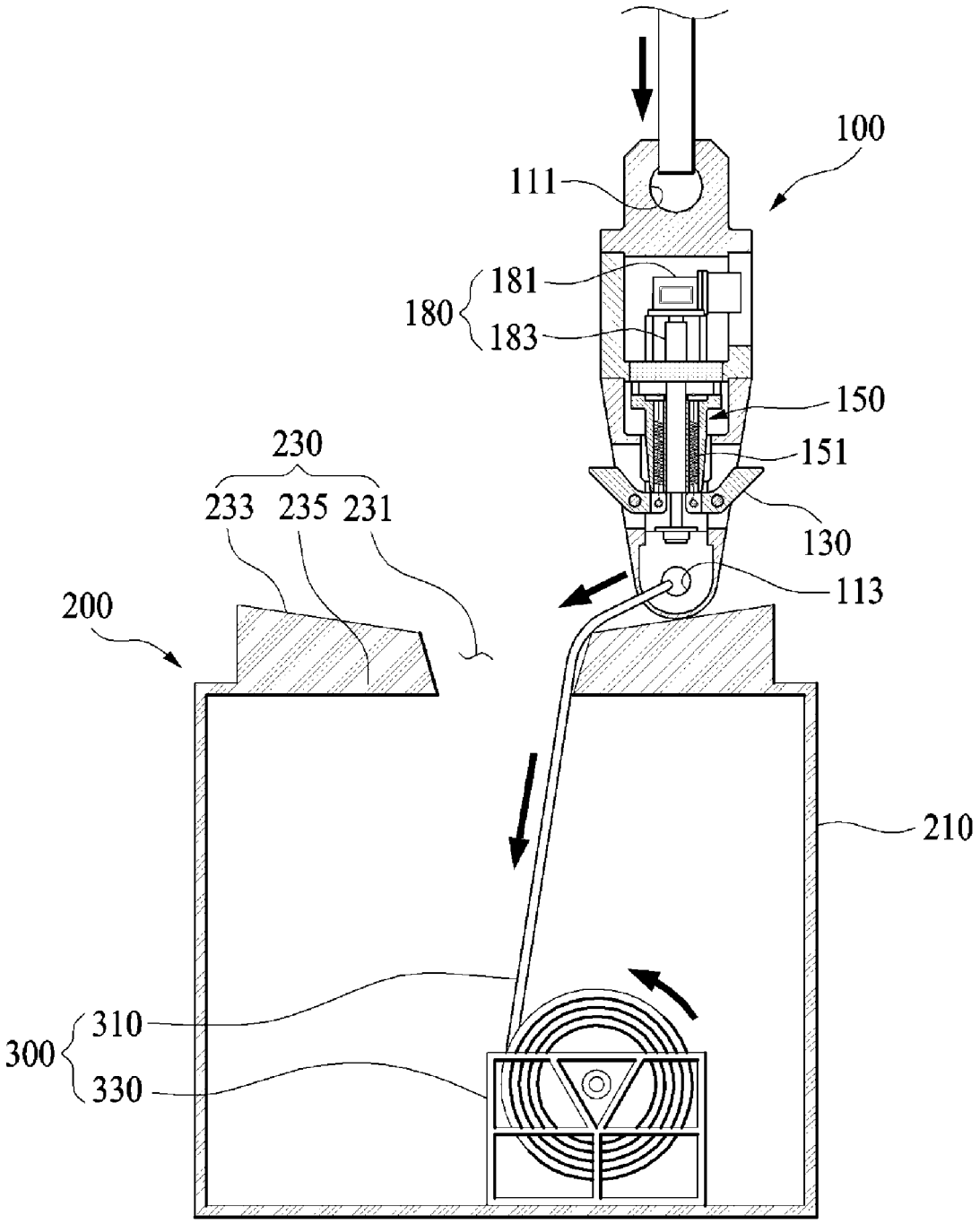
FIG. 8 is a diagram illustrating a coupling device of a coupling control method using a coupling device for recovering an unmanned ship when the coupling device is hung on a guide unit according to an embodiment of the present invention.
Figure 9:
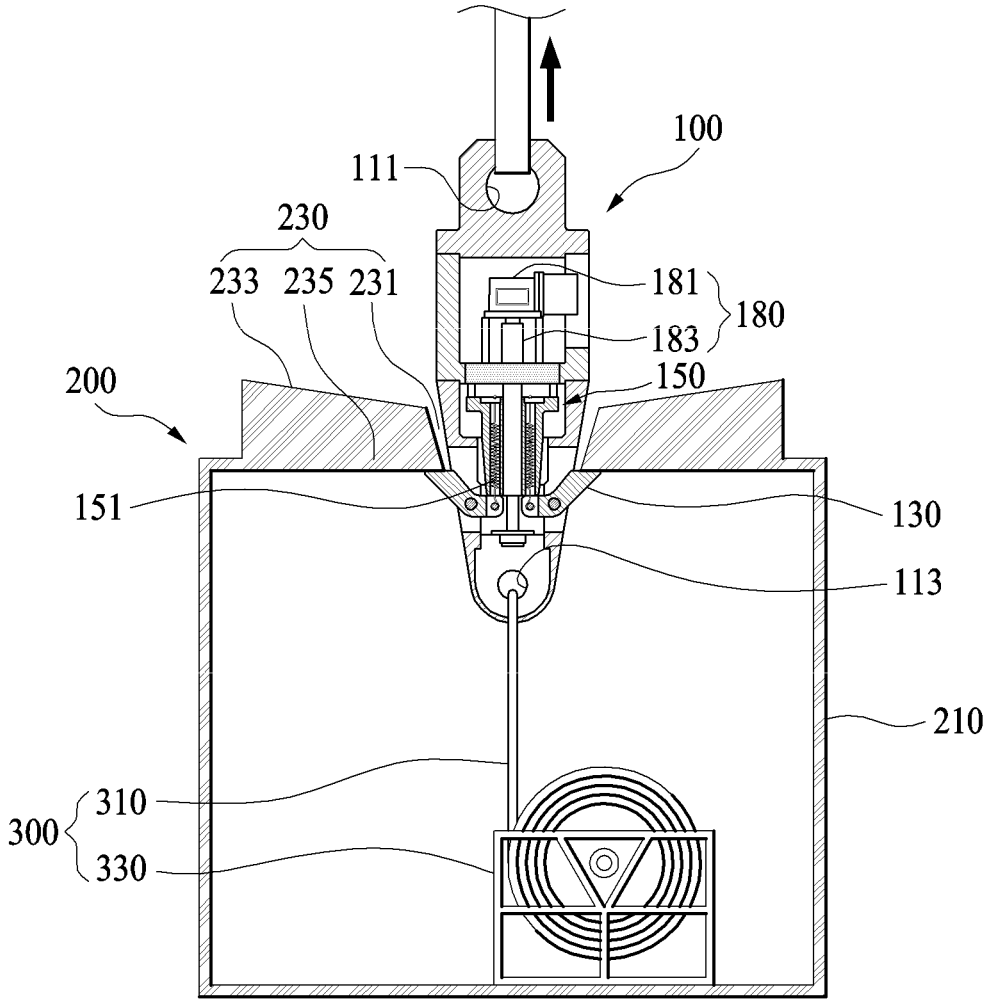
FIG. 9 is a diagram illustrating an unmanned ship of a coupling control method using a coupling device for recovering an unmanned ship when the unmanned ship is recovered to a mother ship according to an embodiment of the present invention.

Next, referring to FIG. 7 to FIG. 9, a coupling unit coupling step and an unmanned ship recovering step of a coupling control method using a coupling device for recovering an unmanned ship according to an embodiment of the present invention will be illustrated.

FIG. 7 is an enlarged view of a coupling device of a coupling control method using a coupling device for recovering an unmanned ship when the coupling device is lowered into a accommodation unit according to an embodiment of the present invention, FIG. 8 is a diagram illustrating a coupling device of a coupling control method using a coupling device for recovering an unmanned ship when the coupling device is hung on a guide unit according to an embodiment of the present invention, and FIG. 9 is a diagram illustrating an unmanned ship of a coupling control method using a coupling device for recovering an unmanned ship when the unmanned ship is recovered to a mother ship according to an embodiment of the present invention.

As shown in FIGS. 7 to 9, the coupling unit coupling step is a step in which, if the intensity of the tension applied to the towing line 310 is the preset value or higher, the coupling unit 100 is lowered and coupled to the accommodation unit 200 in correspondence to the length of the towing line 310 wound by the winch 330.

More specifically, when the winch 330 continuously winds the towing line 310, the unmanned ship 50 that can move on the water may be located in a straight line with respect to the coupling unit 100 in the vertical direction.

Here, the intensity of the tension applied to the towing line 310 may be the pre-set value when the unmanned ship 50 is no longer moving on the water and is about to be lifted to the upper side where the coupling unit 100 is located.

When the intensity of the tension applied to the towing line 310 is the preset value or higher, the sensing part 510 may transmit a signal to the control part 520.

At this time, the control part 520, which received the signal from the sensing part 510, may lower the coupling unit 100 in correspondence to the length of the towing line 310 wound by the winch 330.

More specifically, in order to prevent the coupling device from being overloaded due to lifting of the unmanned ship 50 on the water before coupling with the coupling unit when the intensity of the tension applied to the towing line 310 is the preset value or higher, the controller may control to lower the coupling unit 100 in correspondence to the length of the towing line 310 wound by the winch 330 so that the intensity of the tension applied to the towing line 310 may be maintained not to exceed the set value.

Thus, the coupling unit 100 may be inserted into the accommodation unit 200, while preventing the winch 330 from being overloaded or the towing line 310 from being broken.

Here, when the intensity of the tension applied to the towing line 310 is the preset value or higher, the length L1 of the wire of the crane 30 that lifts and lowers the coupling unit 100 may be lowered to the extent of winding of the length L2 of the towing line 310 wound by the winch 330.

The coupling unit 100 may be lowered in a state in which the coupling unit 100 and the unmanned ship 50 are located in a straight line in the vertical direction so that a portion of the body 110 of the coupling unit 100 where the wing unit 130 is provided can pass through the guide unit 230 and move to the inside of the support unit 210.

Here, as for the wing unit 130 of the coupling unit, the shaft 183 of the driving unit 180 may rotate in one direction from the central axis to move the lifting and lowering unit 150 upward, so that the elastic member 151 coupled to the other side of the wing unit 130 can pull the other side of the wing unit 130 toward the upper side of the body 110 and thus one side of the wing unit 130 may protrude.

When the coupling unit 100 is inserted into the coupling hole 231 as the winch 330 winds the towing line 310, an external force for moving one side of the wing unit 130 into the body 110 while being in contact with the second guide surface 235 may be applied to one side of the protruding wing 130.

At this time, one side of the wing unit 130 may be accommodated into the body 110 by the external force so that the other side of the wing unit 130 may be moved in a downward direction of the body 110 and the length of the elastic member 151 may be increased.

However, when the wing unit 130 passes through the second guide surface 235 and moves to the inside of the support unit 210, the external force applied to one side of the wing unit 130 may be dissipated.

At this time, due to the elastic restoring force of the elastic member 151, the other side of the wing unit 130 may be pulled to the upper side of the body 110, so that one side of the wing unit 130 may protrude to the outside of the body 110.

Thus, one side of the wing unit 130 may be coupled with the inner side of the support unit 210.

When the waves of the sea is so rough that the coupling unit 100 cannot be inserted into the coupling hole 231 but is in contact with the first guide surface 233, the first guide surface 233 may be inclined toward the coupling hole 231 so that the coupling unit 100 can be inserted into the coupling hole 231 when the winch 330 winds the towing line 310.

Next, the unmanned ship recovering step is a step of lifting the unmanned ship 50 by using the crane 30 and recovering the unmanned ship 50 to the mother ship 10.

More specifically, when the coupling unit 100 is coupled to the accommodation unit 200, the control part 520 may stop the operation of the winch 330.

Thus, since the winch 330 does not wind the towing line 310 any longer as the control part 520 stops the operation of the winch 330, after the coupling unit 100 is coupled to the accommodation unit 200, the overload of the winch 330 or the breakage of the towing line 310 can be prevented.

At the same time, the control part 520 may lift the coupling unit 100.

As the coupling unit 100 is lifted in a state of being coupled with the accommodation unit 200, the unmanned ship 50 may be lifted.

Thus, the unmanned ship 50 may be recovered to the mother ship 10.

Next, referring to FIG. 10, a step of disengaging a coupling unit of a coupling control method using a coupling device for recovering an unmanned ship according to an embodiment of the present invention will be described.

Figure 10:
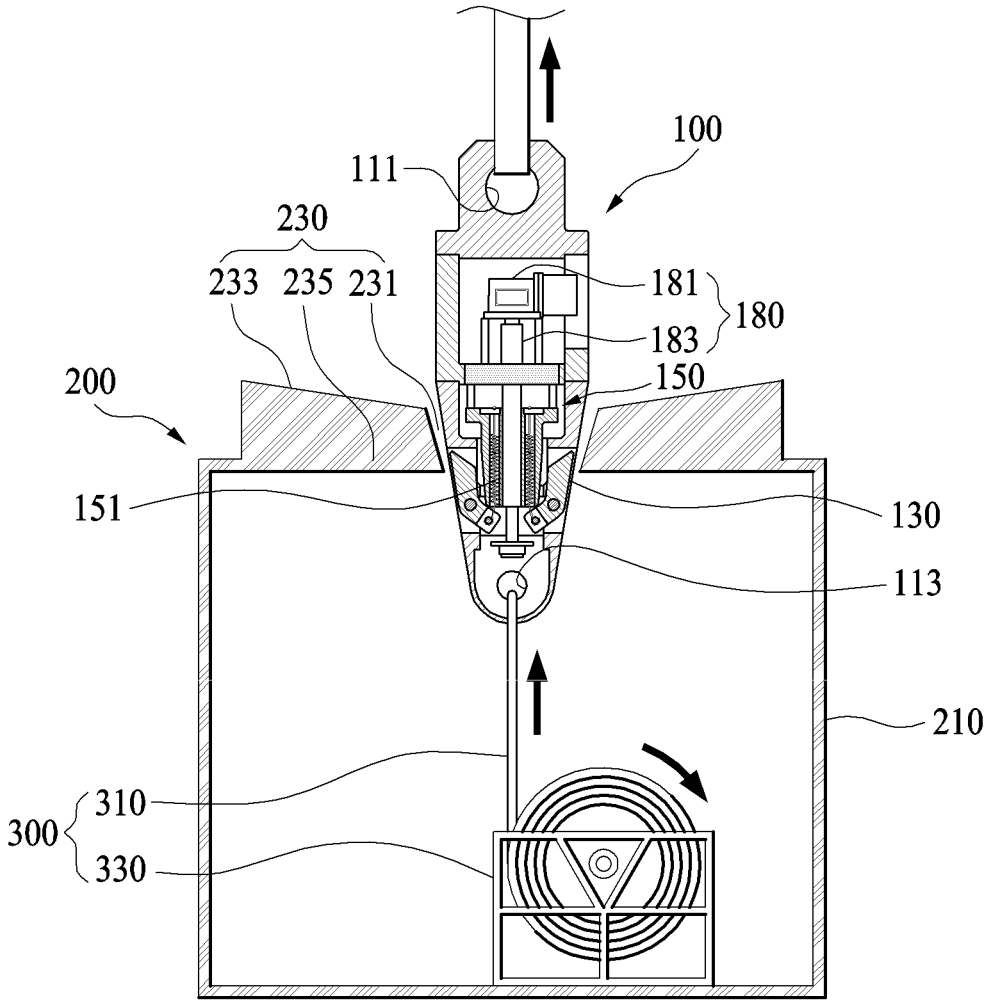
FIG. 10 is a diagram illustrating a coupling unit of a coupling control method using a coupling device for recovering an unmanned ship when the coupling unit is disengaged from an accommodation unit according to an embodiment of the present invention.

FIG. 10 is a diagram illustrating a coupling unit of a coupling control method using a coupling device for recovering an unmanned ship when the coupling unit is disengaged from an accommodation unit according to an embodiment of the present invention.

As shown in FIG. 10, the step of disengaging a coupling unit is a step in which, when the unmanned ship 50 is moved to the mother ship 10, the control part 520 releases the winch 330 and lifts the coupling unit 100 so that the coupling unit 100 can be disengaged from the accommodation unit 200.

More specifically, when the coupling unit 100 and the accommodation unit 200 are coupled and the crane 30 winds the coupling unit 100 to lift the unmanned ship 50 and recover the unmanned ship 50 to the mother ship 10, one side of the wing unit 130 may be accommodated to the body 110 so as to release the coupling unit 100 from the accommodation unit 200.

At this time, since one side of the wing unit 130 is coupled with the support unit 210, the control part 520 may lower the coupling unit 100 to accommodate one side of the wing unit part 130 into the body 110.

Thus, when a space in which one side of the wing unit 130 can be accommodated into the body 110 is formed, the shaft 183 of the driving unit 180 may rotate in the other direction from the center axis and the lifting and lowering unit 150 may be moved to the lower side of the body 110, so that the lifting and lowering unit 150 can push the other side of the wing unit 130 to the lower side of the body 110.

Therefore, the other side of the wing unit 130 may be pushed to the lower side of the body 110 so that one side of the wing unit 130 can be accommodated in the body 110.

At this time, the control part 520 may lift the coupling unit 100 and drive the winch 330 to release the towing line 310 from the winch 330.

Thus, the coupling unit 100 may be disengaged from the accommodation unit 200.

Next, referring to FIG. 11, a process in which an unmanned ship of a coupling control method using a coupling device for recovering an unmanned ship according to an embodiment of the present invention is recovered to a mother ship will be described.

Figure 11:
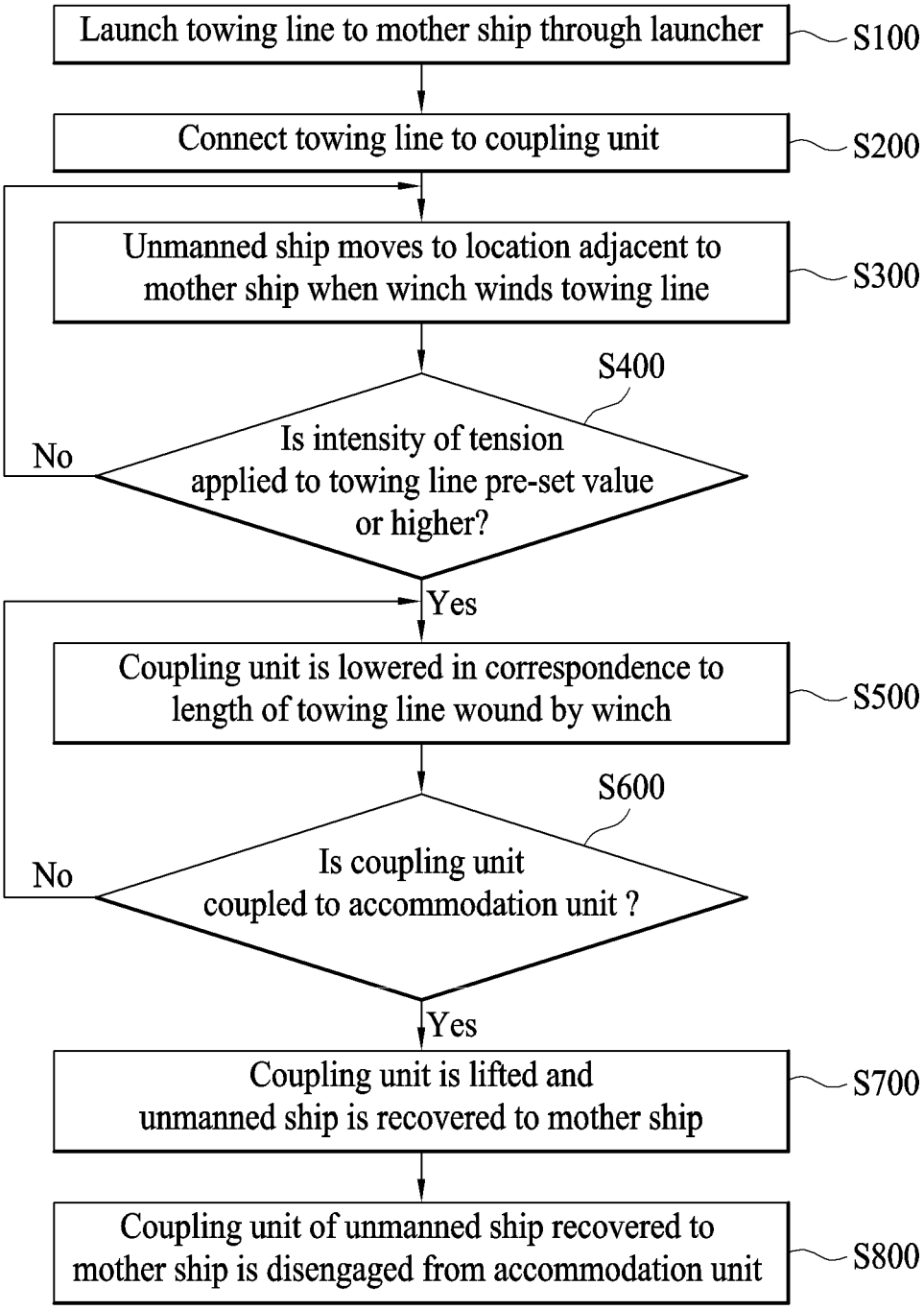
FIG. 11 is a flowchart illustrating an operation procedure of a coupling control method using a coupling device for recovering an unmanned ship according to an embodiment of the present invention.

FIG. 11 is a flowchart illustrating an operation procedure of a coupling control method using a coupling device for recovering an unmanned ship according to an embodiment of the present invention.

As shown in FIG. 11, the unmanned ship 50 that has returned after the completion of the task may launch the launcher 400, to which the towing line 310 is connected, to the mother ship 10 (S100).

Next, a person on the mother ship may connect the towing line 310 launched to the mother ship 10 to the coupling unit 100 connected to the crane 30 (S200).

When the winch 330 winds the towing line 310, the unmanned ship 50 may move to a location adjacent to the mother ship 10 due to the tension applied to the towing line 310 (S300).

When the intensity of the tension applied to the towing line 310 is the pre-set value or higher, the sensing part 510 may transmit a signal to the control part 520. When the intensity of the tension applied to the towing line 310 is lower than the pre-set value, the process may return to step S300 (S400).

The control part 520 may receive a signal from the sensing part 510 and lower the coupling unit 100 in correspondence to the length of the towing line 310 wound by the winch 330 to maintain the intensity of the tension applied to the towing unit 310 at the pre-set value (S500).

When the coupling unit 100 is coupled to the accommodation unit 200, the control part 520 may stop the operation of the winch 330 and lift the coupling unit 100 to lift the unmanned ship 50 from the water surface (S700), and if the coupling unit 100 is not coupled to the accommodation unit 200, the process may return to the step 500 (S600).

The control part 520 may release the winch 330 in the unmanned ship 50 recovered to the mother ship 10 and lift the coupling unit 100 so that the coupling unit 100 can be disengaged from the accommodation unit 200 (S800).

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

(Description of reference numeral)

| | |
|---|---|
| 10: Mother ship | 200: Accommodation unit |
| 30: Crane | 210: Support unit |
| 50: Unmanned ship | 230: Guide unit |
| 100: Coupling unit | 231: Coupling hole |
| 110: Body | 233: First guide surface |
| 130: Wing unit | 235: Second guide surface |
| 150: Lifting and lowering unit | 300: Guide unit |
| 151: Elastic member | 310: Towing line |
| 180: Driving unit | 330: Winch |
| 400: Launcher | 410: Heaving line |
| 430: Launching member | 500: Control unit |
| 510: Sensing part | 520: Control part |

The invention claimed is:

1. A coupling device for recovering an unmanned ship, the coupling device comprising:

a coupling unit lifted and lowered by being connected to a crane provided in a mother ship, one side thereof selectively protruding expansively along a circumference thereof;

an accommodation unit provided in the unmanned ship, and having a vertically communicating coupling hole such that at least a portion of the coupling unit is inserted therein; and a guide unit performing guiding such that the coupling unit is coupled to the accommodation unit, and including a towing line coupled to the coupling unit in a state in which one end thereof passes through the coupling hole, and a winch connected to another end of the towing line so as to selectively wind or unwind the towing line, wherein when an intensity of a tension applied to the towing line by a driving of the winch is a preset value or higher, the coupling unit is configured to be lowered in correspondence to a length of the towing line wound by the winch and to be coupled to the accommodation unit, and wherein the coupling unit comprises:

a body including an upper portion which is connected to the crane;

a wing unit configured to be rotatable in a vertical direction at a portion along a longitudinal direction of the body, and having one side protruding from the body when rotating;

a lifting and lowering unit coupled to other side of the wing unit in the body, and adjusting a location thereof in a vertical direction to control a protrusion of the wing unit; and a driving unit selectively moving the lifting and lowering unit in a vertical direction in the body.

2. The coupling device of claim 1, wherein the winch is configured to wind the towing line so that the unmanned ship is moved to a location adjacent to the mother ship by the towing line wound by the winch, when the intensity of the tension is lower than the pre-set value.

3. The coupling device of claim 1, wherein an operation of the winch is stopped, when the coupling unit and the accommodation unit are coupled.

4. The coupling device of claim 1, wherein the pre-set value is an intensity of the tension applied to the towing line in a state in which the winch winds the towing line and lifts the unmanned ship from a water surface.

5. The coupling device of claim 1, wherein the driving unit is formed in a shaft shape in a vertical direction and selectively rotates, wherein a vertical location of the lifting and lowering unit is adjusted by rotation of the driving unit.

6. The coupling device of claim 1, wherein the lifting and lowering unit has at least one elastic member disposed in a vertical direction, wherein the elastic member is coupled to the other side of the wing unit.

7. The coupling device of claim 6, wherein the coupling unit inserted into the accommodation unit in a state in which the wing unit is expanded, and the wing unit is temporarily folded by an elasticity of the elastic member.

8. The coupling device of claim 1, wherein a plurality of wing units are spaced apart and provided along a circumference of the coupling unit.

9. The coupling device of claim 1, wherein the accommodation unit comprises:

a support unit provided on the unmanned ship; and a guide unit having the coupling hole at an upper portion of the support unit and guiding the coupling unit to be inserted into the coupling hole.

10. The coupling device of claim 9, wherein the guide unit comprises:

a first guide surface having a relatively larger circumference than the coupling unit and having an inclined surface whose circumference decreases toward a lower portion; and a second guide surface continuously formed in a lower portion of the first guide surface and having a relatively larger inclination angle.

11. The coupling device of claim 10, wherein a cross-sectional shape of the first guide surface along a vertical direction is formed to have a curvature in a downward direction.

12. The coupling device of claim 10, wherein the second guide surface is tapered in a vertical direction, and is in contact with an outer surface of the coupling unit.

13. The coupling device of claim 1, wherein the one end of the towing line is launched by a launcher provided in the unmanned ship, is transmitted to the mother ship, and is coupled to the coupling unit.

14. A coupling control method using the coupling device for recovering an unmanned ship according to claim 13, the method comprising:

launching the towing line to the mother ship through the launcher;

coupling the towing line to the coupling unit connected to the crane;

towing the unmanned ship to be adjacent to the mother ship by winding the towing line by the winch;

lowering the coupling unit in correspondence to the length of the towing line wound by the winch and coupling the coupling unit to the accommodation unit when the intensity of the tension applied to the towing line is the preset value or higher; and lifting the unmanned ship by using the crane and recovering the unmanned ship to the mother ship.

15. The method of claim 14, further comprising stopping an operation of the winch and lifting the unmanned ship when the coupling unit and the accommodation unit are coupled to each other.

* * * * *